US011504836B2

(12) United States Patent
Li et al.

(10) Patent No.: US 11,504,836 B2
(45) Date of Patent: Nov. 22, 2022

(54) NAIL STOP BLOCK STRUCTURE FOR STOPPING NAILS AND RESTRAINING

(71) Applicants: Xiaorong Li, Zhejiang (CN); Fazheng Yang, Zhejiang (CN); Zhonghua Jiang, Zhejiang (CN)

(72) Inventors: Xiaorong Li, Zhejiang (CN); Fazheng Yang, Zhejiang (CN); Zhonghua Jiang, Zhejiang (CN)

(73) Assignee: Zhejiang Rongpeng Air Tools Co., Ltd., Zhejiang (CN)

( * ) Notice: Subject to any disclaimer, the term of this patent is extended or adjusted under 35 U.S.C. 154(b) by 278 days.

(21) Appl. No.: 16/869,556

(22) Filed: May 7, 2020

(65) Prior Publication Data

US 2021/0347024 A1 Nov. 11, 2021

(51) Int. Cl.
*B25C 1/04* (2006.01)
*B25C 1/00* (2006.01)

(52) U.S. Cl.
CPC ..... *B25C 1/047* (2013.01); *B25C 1/003* (2013.01)

(58) Field of Classification Search
CPC ..... B25C 1/005; B25C 1/003; B25C 1/047; B25C 1/184; B25C 1/001; B25C 7/00
See application file for complete search history.

(56) References Cited

U.S. PATENT DOCUMENTS

2007/0205246 A1* 9/2007 Jang ..... B25C 1/003 227/110
2010/0258608 A1* 10/2010 Porth ..... B25C 1/00 227/138
2016/0368126 A1* 12/2016 Liu ..... B25C 1/008
2019/0381644 A1* 12/2019 Vandenberg ..... B25C 1/06

* cited by examiner

*Primary Examiner* — Eyamindae C Jallow
*Assistant Examiner* — Veronica Martin

(57) ABSTRACT

A novel nail stop block structure for nail stop and restraining comprises a nail head and a striker hole disposed in the nail head. The front orifice of striker hole is located in the front end face of nail head. A nail head cylinder is disposed on the left lower end of middle part of the nail head. A mobile hole is disposed in the center of upper surface of the nail head cylinder connected to the inner space thereof. An assorted nail feeding piston is disposed in the nail head cylinder. A piston rod coaxial with the mobile hole is disposed on the center of upper surface of the nail feeding piston. The upper end of the piston rod passes upwards through the mobile hole.

3 Claims, 4 Drawing Sheets

NAIL STOP BLOCK STRUCTURE FOR STOPPING NAILS AND RESTRAINING

BACKGROUND OF INVENTION

1. Field of the Invention

The present invention relates generally to a nail stop block structure, and more particularly to a novel nail stop block structure for stopping nails and restraining.

2. Description of Related Art

The pneumatic coil nailer is a pneumatic tool, generally used for connecting the fences for making container pallets and large wooden packing boxes and the timberworks of houses, and for connecting wood furniture and other wooden structures. The pneumatic coil nailer uses the nail feeding mechanism to feed the nail into the striker hole of nail head, and then the striker strikes the nail out of the striker hole to implement nailing. The nail feeding claw and nail stop block are important components in the nail feeding mechanism. The worker can feed the first nail through the nail feeding claw into the striker hole of nail head, and then the nail stop block restrains the first nail. In the meantime, the nail stop block shall make sure the second nail enters the designed path in the pneumatic coil nailer, so that the second nail can be fed into the striker hole of nail head smoothly by the nail feeding claw. However, the nail feeding mechanism of conventional pneumatic coil nailer lacks a restraining structure matching the nail stop block, so when the nail feeding claw returns and gets ready to feed the second nail, the second nail is very likely to deviate from the design path, leading to nail jamming, none of nails enters the striker hole of nail head eventually, forming a blank shot, the service performance of pneumatic coil nailer is influenced.

SUMMARY OF THE INVENTION

The technical problem to be solved by the present invention is a nail stop block structure for stopping nail and restraining, which guarantees that the second nail can be fed into the striker hole of nail head smoothly by the nail feeding claw, preventing nail jamming, so as to avoid blank shots.

The technical solutions adopted by the present invention to solve the above technical problems are:

A novel nail stop block structure for stopping nails and restraining comprising a nail head and a striker hole in the nail head; a front orifice of striker hole disposed in a front end face of the nail head, a nail head cylinder disposed on a left lower end in a middle of the nail head; a mobile hole disposed in a center of an upper surface of the nail head cylinder connected to the inner space thereof; an assorted nail feeding piston disposed in the nail head cylinder; a piston rod coaxial with the mobile hole disposed in a center of an upper surface of the nail feeding piston; an upper end of the piston rod passing upwards through the mobile hole; a nail feed port above the nail head cylinder disposed in a left side of a middle part of the nail head, the nail feed port being connected to the striker hole; a nail feeding claw matching the nail feed port being hinged on the upper end of the piston rod; a hinge part disposed on a right upper end of the nail head; a movable covering plate being hinged on the hinge part; a left sidewall of the movable covering plate having a mounting slot; a bottom of the mounting slot having a first insert hole; a nail stop block being hinged in the mounting slot; a right sidewall of the nail stop block having a second insert hole corresponding to the first insert hole; a spring disposed between the nail stop block and the bottom of mounting slot; one end of the spring being embedded in the first insert hole, another end of spring being embedded in the second insert hole; an upper end of the nail stop block having a restraining step; a front end of the nail feeding claw having a claw head; the restraining step and claw head being enclosed to form a restraining groove.

More preferably, wherein the front and back sides of a left wall of the nail feeding claw including mutually symmetrical hinge wings, the upper end of piston rod is located between the hinge wings; the upper end of the piston rod has a first hinge hole; a lower end of the hinge wing has a second hinge hole coaxial with the first hinge hole; the first axle pin passes through the second hinge hole and the first hinge hole on the right side and the second hinge hole on the left side in turn and is provided with a first pin bush; an angle limiting block is disposed on the right side of an upper end of the hinge wing; an angle limiting hole is disposed in the upper end of the hinge wing; the right and left angle limiting holes are connected by an elastic cylindrical pin; the elastic cylindrical pin is located on the left side of angle limiting block.

More preferably, wherein the hinge part includes a front link disposed on the right side of foreside of the nail head and a rear link disposed on the right side of backside of nail head; the front link is provided with a front hinge hole, and the rear link is provided with a rear hinge hole coaxial with front hinge hole; the upper end of the movable covering plate is located between the front link and rear link; the upper end of movable covering plate is provided with a middle hinge hole; one end of the second axle pin passes through the front hinge hole, middle hinge hole and rear hinge hole in turn, and it is provided with a second pin bush.

More preferably, wherein the lower end of the nail stop block is provided with a third hinge hole; a fourth hinge hole connected to the mounting slot is disposed in the rear side of the movable covering plate; the fourth hinge hole is coaxial with the third hinge hole; a fifth hinge hole connected to the mounting slot is disposed in the front side of lower part of the movable covering plate; the fifth hinge hole is coaxial with the fourth hinge hole; one end of the third axle pin passes through the fifth hinge hole, the third hinge hole and the fourth hinge hole in turn, and it is provided with a third pin bush.

More preferably, wherein the step surface of the restraining step including a bayonet.

The effect of the present invention is as follows:

In comparison to the existing technology, the novel nail stop block structure for stopping nail and restraining of the present invention can squeeze the second nail in the designed path through the left wall of nail stop block, the compacting force of nail stop block comes from the spring, so the second nail will never deviate from the designed path if the second nail keeps still. When the nail feeding claw feeds the first nail into the striker hole of nail head quickly, the second nail squeezes the nail stop block away under the power of nail feeding mechanism, moving into the restraining groove the first nail was in. When the second nail is restrained, the position stability of the second nail when the first nail is struck out can be guaranteed, so that the second nail can enter the striker hole quickly and accurately after the first nail is struck out of the striker hole, so as to get ready for next nailing. When the second nail moves, the following nails move synchronously. However, no matter how it moves, the following nails will be restrained in the restraining groove and limited to the designed path, so as to effectively prevent the following nails from deviating from the designed path without a restraining structure, preventing nail jamming effectively, and there will not be blank shots.

DETAILED DESCRIPTION OF THE INVENTION

Figure 1:
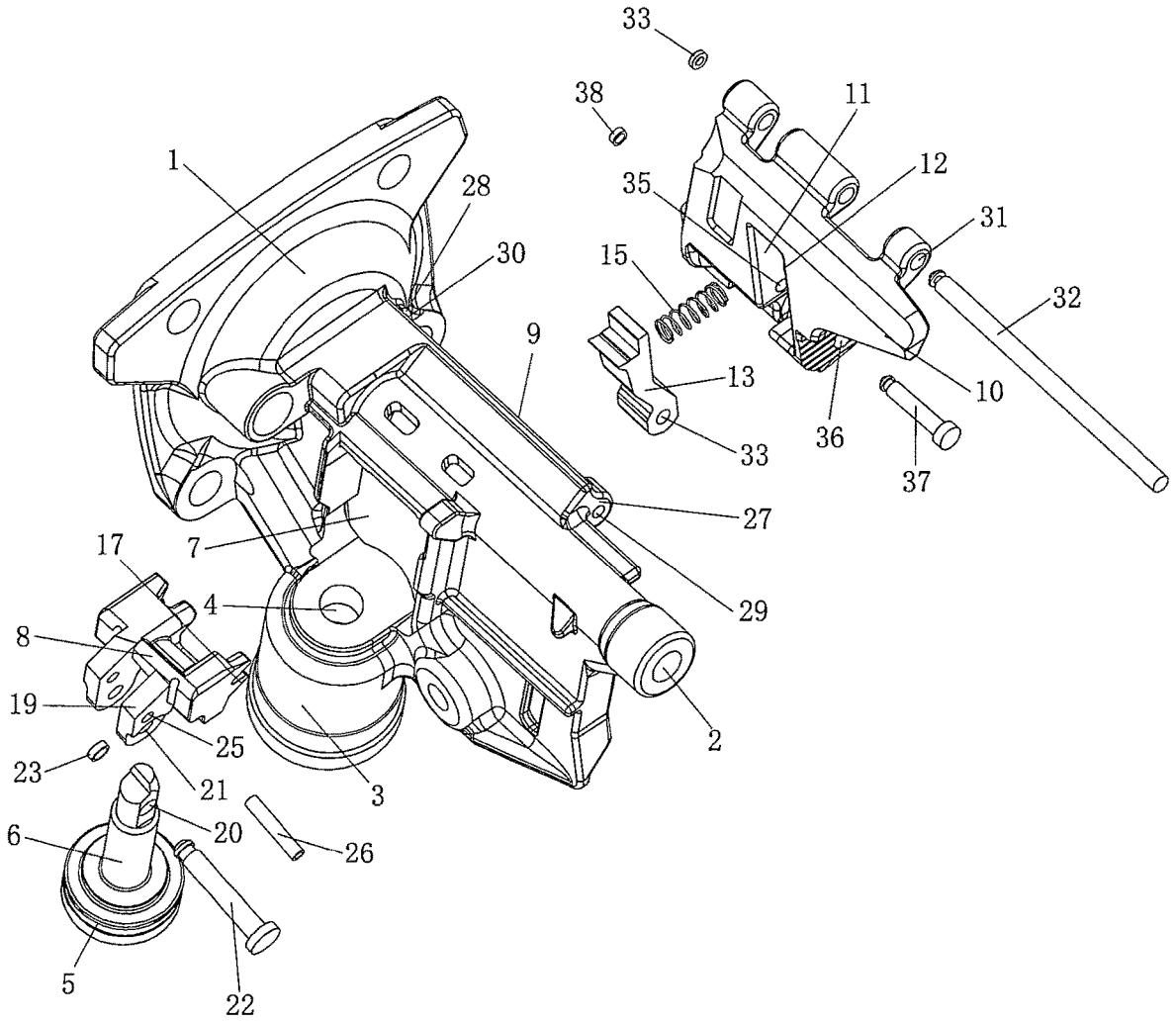
FIG. 1 is a schematic diagram of the novel nail stop block structure for stopping nails and restraining of the present invention.
Figure 2:
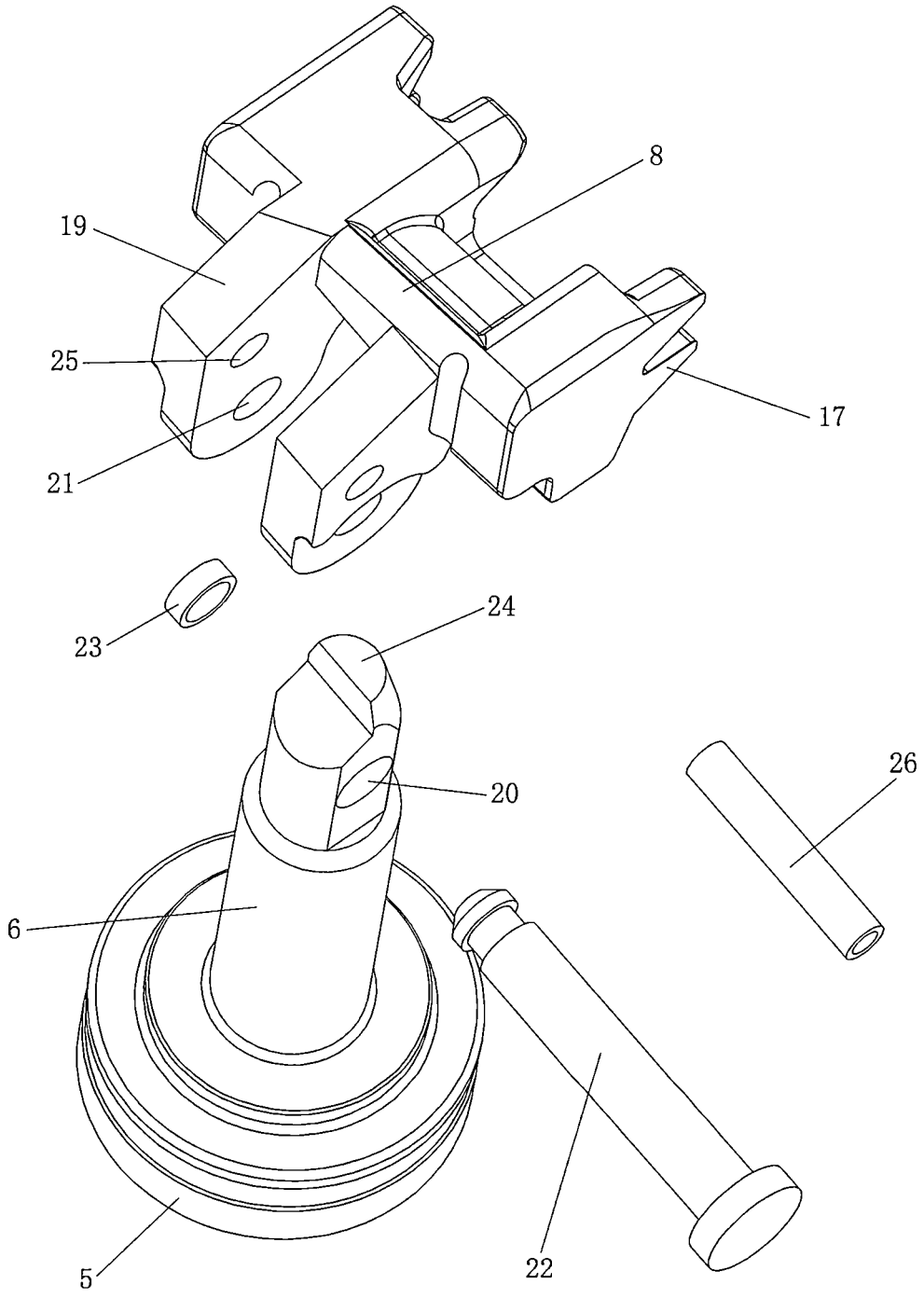
FIG. 2 is a structural representation of the assembled piston rod and nail feeding claw.
Figure 3:
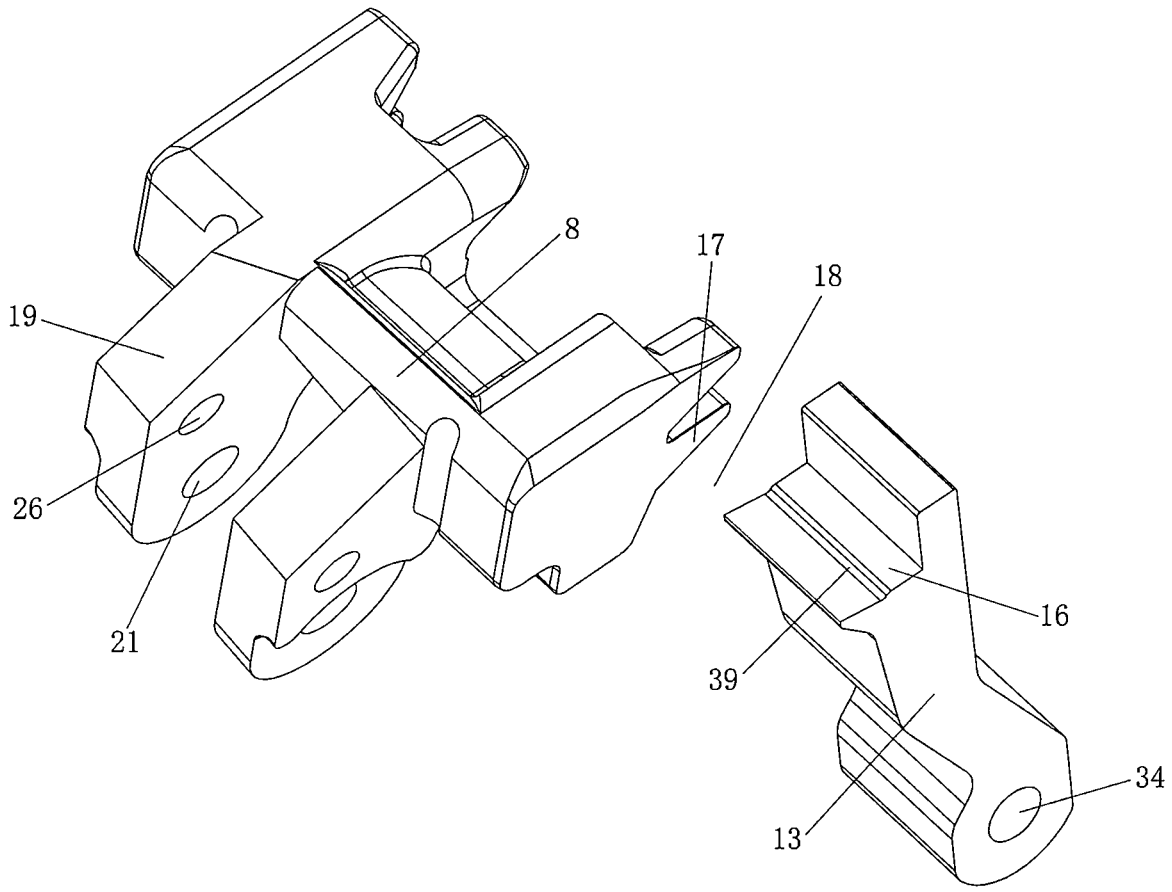
FIG. 3 is a structural representation of the assembled nail feeding claw and nail stop block.
Figure 4:
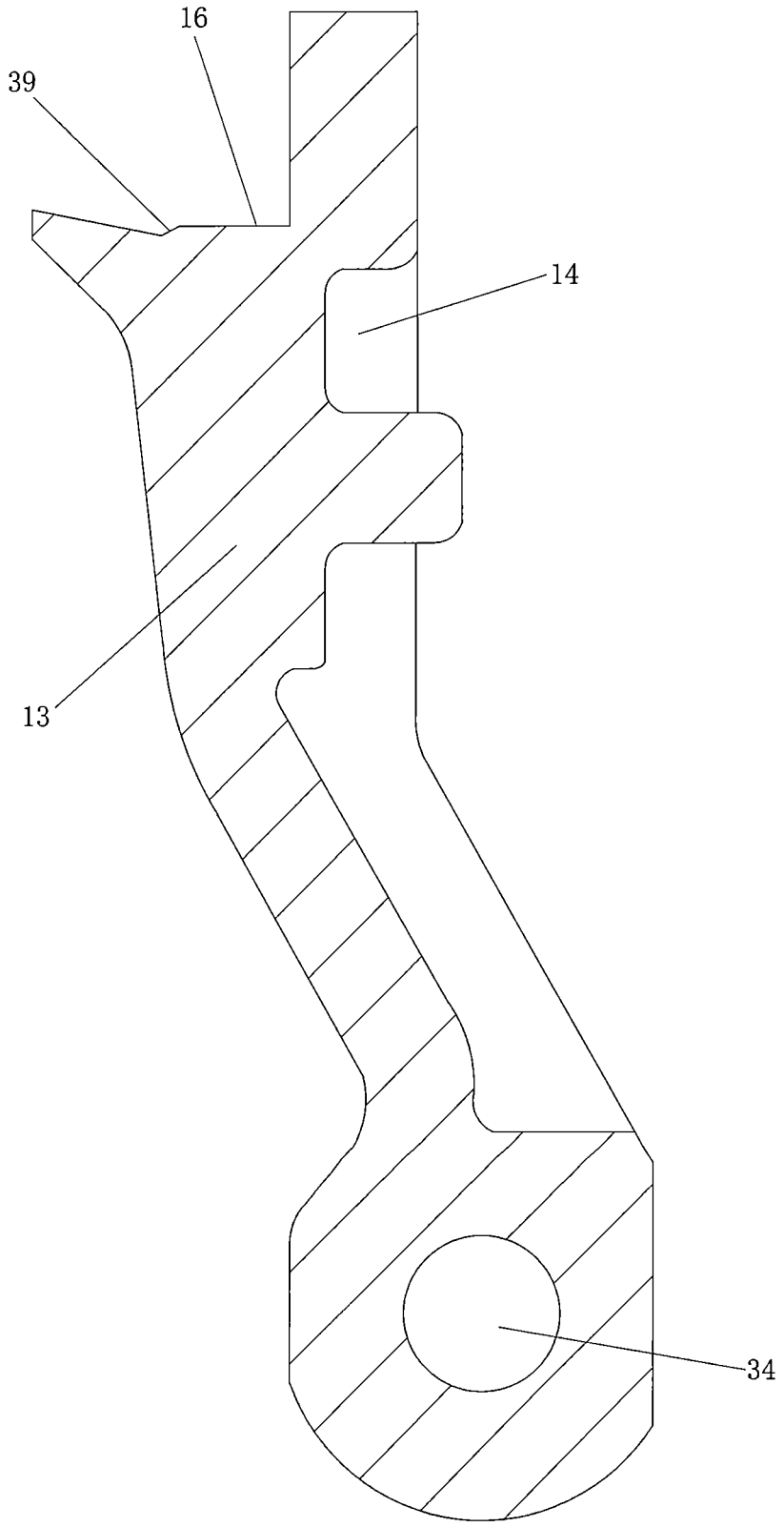
FIG. 4 is the sectional view of nail stop block.

Referring to FIG. 1 to FIG. 4, a novel nail stop block structure for stopping nails and restraining comprises a nail head 1 and a striker hole 2 disposed in nail head 1. The front orifice of striker hole 2 is located in the front end face of nail head 1. A nail head cylinder 3 is disposed in the left lower end in the middle of the nail head 1. There is a mobile hole 4 in the center of upper surface of the nail head cylinder 3 connected to the inner space thereof. An assorted nail feeding piston 5 is located in the nail head cylinder 3. A piston rod 6 coaxial with mobile hole is located in the center of upper surface of the nail feeding piston 5. The upper end of the piston rod 6 passes upwards through the mobile hole 4. A nail feed port 7 above the nail head cylinder 3 is disposed on the left side of middle part of the nail head 1, the nail feed port 7 is connected to striker hole 2. A nail feeding claw 8 matching the nail feed port 7 is hinged on the upper end of the piston rod 6. A hinge part 9 is disposed on the right upper end of the nail head 1. A movable covering plate 10 is hinged on the hinge part 9. A mounting slot 11 is disposed in the left sidewall of the movable covering plate 10. A first insert hole 12 is located in the bottom of the mounting slot 11. A nail stop block 13 is hinged in the mounting slot 11. A second insert hole 14 corresponding to the first insert hole 12 is located in the right sidewall of the nail stop block 13. There is a spring 15 between the nail stop block 13 and the bottom of mounting slot 11. One end of the spring 15 is embedded in the first insert hole 12, the other end of spring 15 is embedded in the second insert hole 14. A restraining step 16 is disposed on the upper end of the nail stop block 13. A claw head 17 is disposed on the front end of the nail feeding claw 8. The restraining step 16 and claw head 17 are enclosed to form a restraining groove 18.

There are mutually symmetrical hinge wings 19 on the front and back sides of left wall of the nail feeding claw 8. The upper end of piston rod 6 is located between the hinge wings 19. A first hinge hole 20 is disposed in the upper end of the piston rod 6. A second hinge hole 21 coaxial with the first hinge hole 20 is disposed in the lower end of the hinge wings 19. The first axle pin 22 passes through the second hinge hole 21 and the first hinge hole 20 on the right side and the second hinge hole 21 on the left side in turn, and it is provided with a first pin bush 23. An angle limiting block 24 is disposed on the right side of upper end of the hinge wings 19. An angle limiting hole 25 is disposed in the upper end of the hinge wings 19. The right and left angle limiting holes 25 are connected by an elastic cylindrical pin 26, the elastic cylindrical pin 26 is located on the left side of angle limiting block 24.

The hinge part 9 comprises a front link 27 on the right side of foreside of nail head and a rear link 28 on the right side of backside of nail head 1. The front link 27 is provided with a front hinge hole 29, the rear link 28 is provided with a rear hinge hole 30 coaxial with the front hinge hole 29. The upper end of the movable covering plate 10 is located between front link 27 and rear link 28. The upper end of movable covering plate 10 is provided with a middle hinge hole 31. One end of the second axle pin 32 passes through the front hinge hole 29, middle hinge hole 31 and rear hinge hole 30 in turn, and it is provided with a second pin bush 33.

The lower end of the nail stop block 13 is provided with a third hinge hole 34. The rear side of the movable covering plate 10 is provided with a fourth hinge hole 35 connected to the mounting slot 11. The fourth hinge hole 35 is coaxial with the third hinge hole 34. A fifth hinge hole 36 connected to mounting slot 11 is disposed in the front side of lower part of the movable covering plate 10. The fifth hinge hole 36 is coaxial with the fourth hinge hole 35. One end of the third axle pin 37 passes through the fifth hinge hole 36, the third hinge hole 34 and the fourth hinge hole 35 in turn, and it is provided with a third pin bush 38.

The step surface of the restraining step 16 is provided with a bayonet 39.

The usage of the present invention is described below:

Before the nail feeding claw 8 feeds nails, the first nail in the nail magazine of pneumatic coil nailer is stuck in the restraining groove formed by the restraining step 16 of nail stop block 13 and the claw head 17 of nail feeding claw 8, and the second nail is held down in the designed path by the left sidewall of nail stop block 13. The compacting force of nail stop block 13 comes from the spring force of spring 15, so when the nail feeding mechanism of pneumatic coil nailer pushes the coil nails in the nail magazine, the second nail can easily push the nail stop block 13 away along the left wall of nail stop block 13, there will not be nail jamming.

For nailing, the nail feeding piston 5 in the nail head cylinder 3 is pulled down by air pressure, the nail feeding piston 5 moves down, and the piston rod 6 disposed in the center of upper surface of nail feeding piston 5 moves down along the trajectory of mobile hole 4. When the piston rod 6 moves down, the nail feeding claw 8 restricted by the inner wall of nail feed port 7 rotates round the first axle pin 22, as the nail feeding claw 8 rotates, the claw head 17 of nail feeding claw 8 gets away from the restraining step 16 of nail stop block 13 gradually, the position of connection between the restraining groove 18 and striker hole 2 of nail head 1 is enlarged, the first nail enters the striker hole 2 quickly along the trajectory of claw head 17 as the nail feeding claw 8 rotates. When the first nail enters the striker hole 2, the nail feeding piston 5 drives the piston rod 6 to shift up and reset, the nail feeding claw 8 is resetted, the position of connection between the restraining groove 18 and striker hole 2 narrows quickly, in the meantime, the second nail moves toward the restraining groove 18 along the left wall trajectory of nail stop block 13 under the effect of the nail feeding mechanism of pneumatic coil nailer. In the moving process of the second nail, the second nail extrudes the nail stop block 13 to the right, the spring 15 is compressed. When the second nail enters the restraining groove 18, the second nail is confined to the restraining groove 18 by the claw head 17 of nail feeding claw 8 and the restraining step 16 of nail stop block 13. The third nail replaces the second nail, it is held down in the designed path by the left wall of nail stop block 13. When the first nail is struck out of the striker hole 2 by the striker, the second nail enters the striker hole 2 of nail head 1 quickly as the first nail does, so as to get ready for next nailing. The third nail enters the restraining groove 18. This process is repeated to implement continuous nailing.

To sum up, the left wall of nail stop block 13 of the present invention holds down the second nail in the designed path, and the compacting force of nail stop block 13 comes from the spring 15, so when the second nail keeps still, the second nail will not deviate from the designed path. When the nail feeding claw feeds the first nail into the striker hole 2 of nail head 1 quickly, the second nail pushes the nail stop block 13 away under the power of nail feeding mechanism, moving into the restraining groove 18 the first nail was in. When the second nail is restrained, the position stability of the second nail when the first nail is struck out can be guaranteed, so that the second nail can enter the striker hole 2 quickly and accurately when the first nail is struck out of the striker hole 2, so as to get ready for next nailing. When the second nail moves, the following nails move synchronously, however it moves, the following nails are restrained in the restraining groove 18 and limited to the designed path, effectively preventing the following nails from deviating from the designed path without a restraining structure, effectively avoiding nail jamming, so that there will not be blank shot.

An angle limiting block 24 is disposed on the right side of upper end of hinge wings 19. An angle limiting hole 25 is disposed in the upper end of hinge wings 19. The left and right angle limiting holes 25 are connected by an elastic cylindrical pin 26. The elastic cylindrical pin 26 is located on the left side of angle limiting block 24. When the nail feeding claw 8 rotates round the first axle pin 22, the elastic cylindrical pin 26 shifts accordingly. When the elastic cylindrical pin 26 moves to an angle, it contacts the angle limiting block 24, the angle limiting block 24 restricts the movement of elastic cylindrical pin 26, so as to restrict the rotation angle of nail feeding claw 8. The rotational degree of freedom of nail feeding claw 8 guarantees the nail feeding stability of nail feeding claw 8, to avoid excessive rotation angle inducing deviation of nail feeding position.

The step surface of restraining step 16 is provided with a bayonet 39, when the nail is limited to the restraining groove 18 formed by the restraining step 16 of nail stop block 13 and the claw head 17 of nail feeding claw 8, the nail can be embedded in the bayonet 39, so that the nail is further confined, the restraining effect is enhanced.

We claim:

1. A novel nail stop block structure for stopping nails and restraining comprising a nail head and a striker hole in the nail head; a front orifice of striker hole disposed in a front end face of the nail head, a nail head cylinder disposed on a left lower end in a middle of the nail head;

a mobile hole disposed in a center of an upper surface of the nail head cylinder connected to the inner space thereof;

an assorted nail feeding piston disposed in the nail head cylinder;

a piston rod coaxial with the mobile hole disposed in a center of an upper surface of the nail feeding piston; an upper end of the piston rod passing upwards through the mobile hole;

a nail feed port above the nail head cylinder disposed in a left side of a middle part of the nail head, the nail feed port being connected to the striker hole;

a nail feeding claw matching the nail feed port being hinged on the upper end of the piston rod;

a hinge part disposed on a right upper end of the nail head;

a movable covering plate being hinged on the hinge part; a left sidewall of the movable covering plate having a mounting slot; a bottom of the mounting slot having a first insert hole;

a nail stop block being hinged in the mounting slot; a right sidewall of the nail stop block having a second insert hole corresponding to the first insert hole;

a spring disposed between the nail stop block and the bottom of mounting slot; one end of the spring being embedded in the first insert hole, another end of spring being embedded in the second insert hole;

an upper end of the nail stop block having a restraining step; a front end of the nail feeding claw having a claw head; the restraining step and claw head being enclosed to form a restraining groove;

wherein the front and back sides of a left wall of the nail feeding claw including mutually symmetrical hinge wings, the upper end of piston rod is located between the hinge wings; the upper end of the piston rod has a first hinge hole;

a lower end of the hinge wing has a second hinge hole coaxial with the first hinge hole; the first axle pin passes through the second hinge hole and the first hinge hole on the right side and the second hinge hole on the left side in turn and is provided with a first pin bush;

an angle limiting block is disposed on the right side of an upper end of the hinge wing; an angle limiting hole is disposed in the upper end of the hinge wing; the right and left angle limiting holes are connected by an elastic cylindrical pin; the elastic cylindrical pin is located on the left side of angle limiting block.

2. The novel nail stop block structure for stopping nails and restraining defined in claim 1, wherein the hinge part includes a front link disposed on the right side of foreside of the nail head and a rear link disposed on the right side of backside of nail head; the front link is provided with a front hinge hole, and the rear link is provided with a rear hinge hole coaxial with front hinge hole; the upper end of the movable covering plate is located between the front link and rear link; the upper end of movable covering plate is provided with a middle hinge hole; one end of the second axle pin passes through the front hinge hole, middle hinge hole and rear hinge hole in turn, and it is provided with a second pin bush.

3. The novel nail stop block structure for stopping nails and restraining defined in claim 1, wherein the lower end of the nail stop block is provided with a third hinge hole; a fourth hinge hole connected to the mounting slot is disposed in the rear side of the movable covering plate; the fourth hinge hole is coaxial with the third hinge hole; a fifth hinge hole connected to the mounting slot is disposed in the front side of lower part of the movable covering plate; the fifth hinge hole is coaxial with the fourth hinge hole; one end of the third axle pin passes through the fifth hinge hole, the third hinge hole and the fourth hinge hole in turn, and it is provided with a third pin bush.

* * * * *